US008262014B1

(12) United States Patent
Selby

(10) Patent No.: US 8,262,014 B1
(45) Date of Patent: Sep. 11, 2012

(54) DEVICE FOR STORING AND DISPENSING FLEXIBLE TUBING

(76) Inventor: William J. Selby, Stoughton, MA (US)

( * ) Notice: Subject to any disclaimer, the term of this patent is extended or adjusted under 35 U.S.C. 154(b) by 40 days.

(21) Appl. No.: 12/964,809

(22) Filed: Dec. 10, 2010

Related U.S. Application Data

(63) Continuation-in-part of application No. 12/786,715, filed on May 25, 2010.

(51) Int. Cl.
*B65H 49/00* (2006.01)

(52) U.S. Cl. ..... 242/588.3; 242/588.4; 242/588.6; 242/615.4; 206/395

(58) Field of Classification Search .... 242/588.3–588.4, 242/588.6, 129, 615.4; 206/395, 409
See application file for complete search history.

(56) References Cited

U.S. PATENT DOCUMENTS 1,826,084 A * 10/1931 Mohr ..... 242/137.1
3,680,810 A * 8/1972 Jarmalow ..... 242/171
3,693,784 A * 9/1972 Holmes ..... 206/409
5,246,111 A * 9/1993 Shibazaki et al. ..... 206/409
5,826,817 A * 10/1998 Selby ..... 242/588.6
D503,337 S 3/2005 Selby
D509,147 S 9/2005 Selby
D626,429 S * 11/2010 Selby ..... D9/715
D638,721 S * 5/2011 Selby ..... D9/715

* cited by examiner

*Primary Examiner* — Sang Kim
(74) *Attorney, Agent, or Firm* — Steven N. Fox, Esq.

(57) ABSTRACT

The present invention is a device for storing, displaying, and dispensing flexible tubing upon a store shelf. In one embodiment, the device comprises a one-piece housing having inner and outer bottom walls, a rear wall extending upward from the outer bottom wall, and first and second sidewalls. The first sidewall extends upward from the inner bottom wall and is substantially perpendicular to the rear wall. The first sidewall comprises a smooth leading wall, a curved edge, and a trailing straight edge. The second sidewall extends upward from the outer bottom wall and is substantially perpendicular to the rear wall and parallel to the first sidewall. The second sidewall comprises a smooth leading wall, a curved edge, and a trailing straight edge. The smooth leading walls of the first and second sidewalls may be formed by first and second flaps that are folded upon inside surfaces of the first and second sidewalls, respectively.

6 Claims, 11 Drawing Sheets

DEVICE FOR STORING AND DISPENSING FLEXIBLE TUBING

CROSS-REFERENCE TO RELATED APPLICATIONS

This application claims priority to and is a continuation-in-part of application Ser. No. 12/786,715 filed on May 25, 2010, now pending, which is hereby incorporated by reference in its entirety into this specification.

BACKGROUND OF THE INVENTION

Various types of devices have been developed for storing, displaying, and dispensing of materials such as flexible tubing. U.S. Pat. No. 5,826,817 discloses a cardboard box having a bottom wall, sidewalls, a front end wall with a window, a rear end wall, and a spool member spanning from first sidewall to second sidewall. Flexible tubing is wrapped around the spool member and dispensed thru the window. Such conventional devices have enjoyed considerable success. However, such conventional devices often slip on the shelf when the tubing is pulled by the customer causing damage to the front of the cardboard box. Another disadvantage with conventional devices is that a significant amount of material is employed increasing the overall cost of the device. These conventional devices are typically made from a one-piece corrugated card board that is cut and folded into the shape of the desired box. Another problem with such conventional storing and dispensing devices is the sharpness of the outside edges of the sidewalls. Such conventional devices dispense the flexible tube from the front of the box which have exposed sharp paper edges that might cause cut a paper cut to the consumer.

SUMMARY OF THE INVENTION

One object of the present invention to provide a device for storing, displaying, and dispensing flexible tubing on a store shelf that will resist slipping and damage when the flexible tubing is dispensed by the customer.

Another object of the present invention is to provide a device for storing, displaying, and dispensing flexible tubing that uses less material and is significantly less expensive to manufacture than conventional devices.

It is still another object of the present invention to provide a device for storing, displaying, and dispensing flexible tubing that substantially prevents paper cuts to the user's fingers from sharp outside edges at the front of the device during dispensing.

The present invention is a device for storing, displaying, and dispensing flexible tubing upon a store shelf. In one embodiment, the device comprises a one-piece housing having inner and outer bottom walls, a rear wall extending upward from the outer bottom wall, and first and second sidewalls. The first sidewall extends upward from the inner bottom wall and is substantially perpendicular to the rear wall. The first sidewall comprises a smooth leading wall, a curved edge, and a trailing straight edge. The second sidewall extends upward from the outer bottom wall and is substantially perpendicular to the rear wall and parallel to the first sidewall. The second sidewall comprises a smooth leading wall, a curved edge, and a trailing straight edge. The smooth leading walls of the first and second sidewalls may be formed by first and second flaps that are folded upon inside surfaces of the first and second sidewalls, respectively. The device further comprises a spool assembly engaged with the first and second sidewalls. The device further comprises a flexible tubing wrapped about the spool member. The device further comprises a bumper engaged with the front edges of the inner and outer bottom walls. The bumper extends substantially from the first sidewall to the second sidewall. In use, the bumper provides frictional support to the device against the pulling force applied by a customer when dispensing the flexible tubing. The smooth leading walls of the first and second sidewalls along with the bumper substantially reduce the likelihood of a customer receiving a paper-cut while dispensing the flexible tubing.

BRIEF DESCRIPTION OF THE DRAWINGS

The following description of the invention shall be further understood with reference to the accompanying drawings, in which.

DESCRIPTION OF INVENTION

Figure 1:
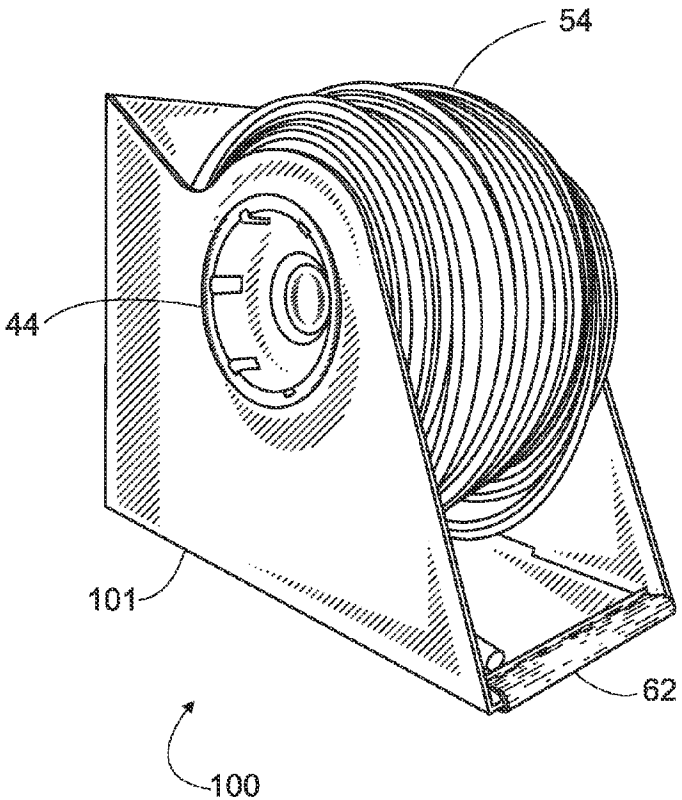
FIG. 1 is a perspective view of a device according to a first embodiment of the present invention with flexible tubing fully wound upon the spool assembly.

Referring to FIG. 1, the present invention is a package or device 100 for storing, displaying, and dispensing articles such as flexible tubing 54 on a store self (not shown). Device 100 generally comprises a one-piece housing 101, a spool assembly 44, flexible tubing 54 wound upon a spool assembly 44, and a bumper 62.

Figure 2:
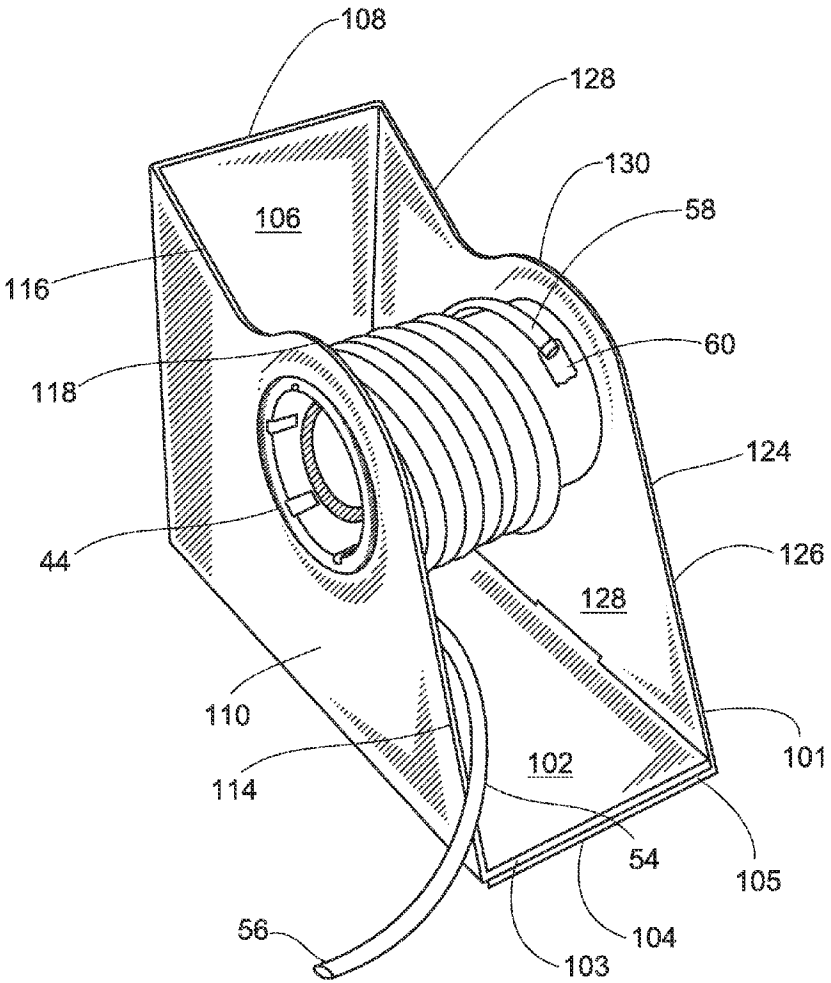
FIG. 2 is a perspective view of the device of the first embodiment shown with the flexible tubing substantially dispensed.

Referring to FIG. 2, one piece housing 101 generally comprises an inner bottom wall 102, an outer bottom wall 104, a rear wall 106, a first side wall 110, and a second side wall 122. Inner and outer bottom walls 102 and 104 comprise a front edge 103 and a front edge 105, respectively. Rear wall 106 comprises an outside edge 108. First and second sidewalls 110 and 122 further comprise outside edges 112 and 124, respectively. First and second sidewalls 110 and 122 extend upward from inner bottom wall 102 and are substantially perpendicular to rear wall 106. Outside edge 112 of first sidewall 110 further comprises a leading straight edge 114, a trailing straight edge 116, and a curved edge 118. Curved edge 118 is disposed between leading and trailing straight edge portions 114 and 116. Outside edge 124 of second sidewall 122 further comprises a leading straight edge 126, a trailing straight edge 128 and a curved edge 130. Curved edge 130 is disposed between leading and trailing straight edges 126 and 128. As will be described more fully herein, one-piece housing 101 is fabricated from a sheet of cardboard (FIG. 6) by cutting, folding, and stapling operations.

Figure 3:
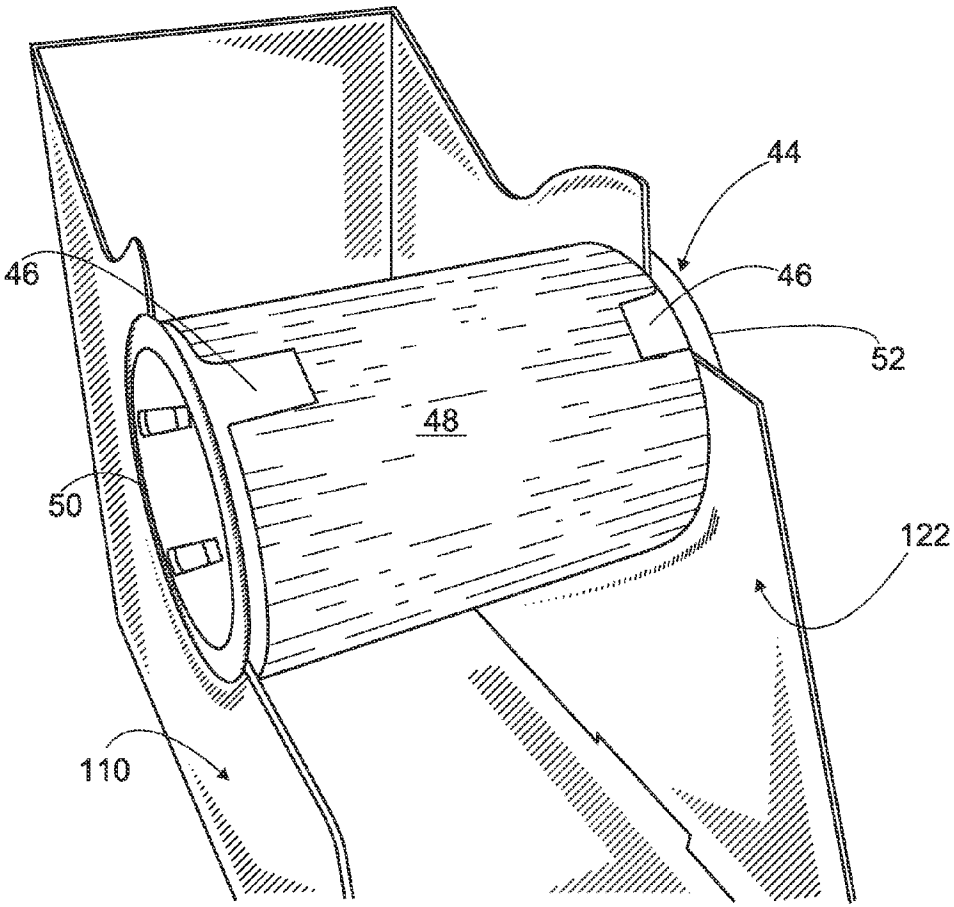
FIG. 3 is a perspective view of the device of the first embodiment wherein the left and right sidewalls are partially cut away to show the spool assembly.

Referring to FIG. 3, spool assembly 44 comprises an inner spool 46, an outer spool 48, a left flange 50 and a right flange 52. Left and right flanges 50 and 52 are engaged with the open ends of inner spool 46 thru openings 120 and 132 (FIG. 6) of first and second sidewalls 110 and 122, respectively. Outer spool 48 freely rotates about inner spool 46.

Referring back to FIG. 2, flexible tubing 54 is wrapped about outer spool 48 toward a substantially radial position outward of leading and trailing straight edges 114 and 116 of first sidewall 110 and leading and trailing straight edges 126 and 128 of second sidewall 122. Flexible tubing 54 further comprises an inside end 58 and an outside end 56. Inside end 58 is attached to spool assembly 44 by a fastener 60. In the embodiment shown, fastener 60 is a conventional piece of adhesive tape. In other embodiments, fastener 60 may be staples or any other well-known type of fastener.

Figure 4:
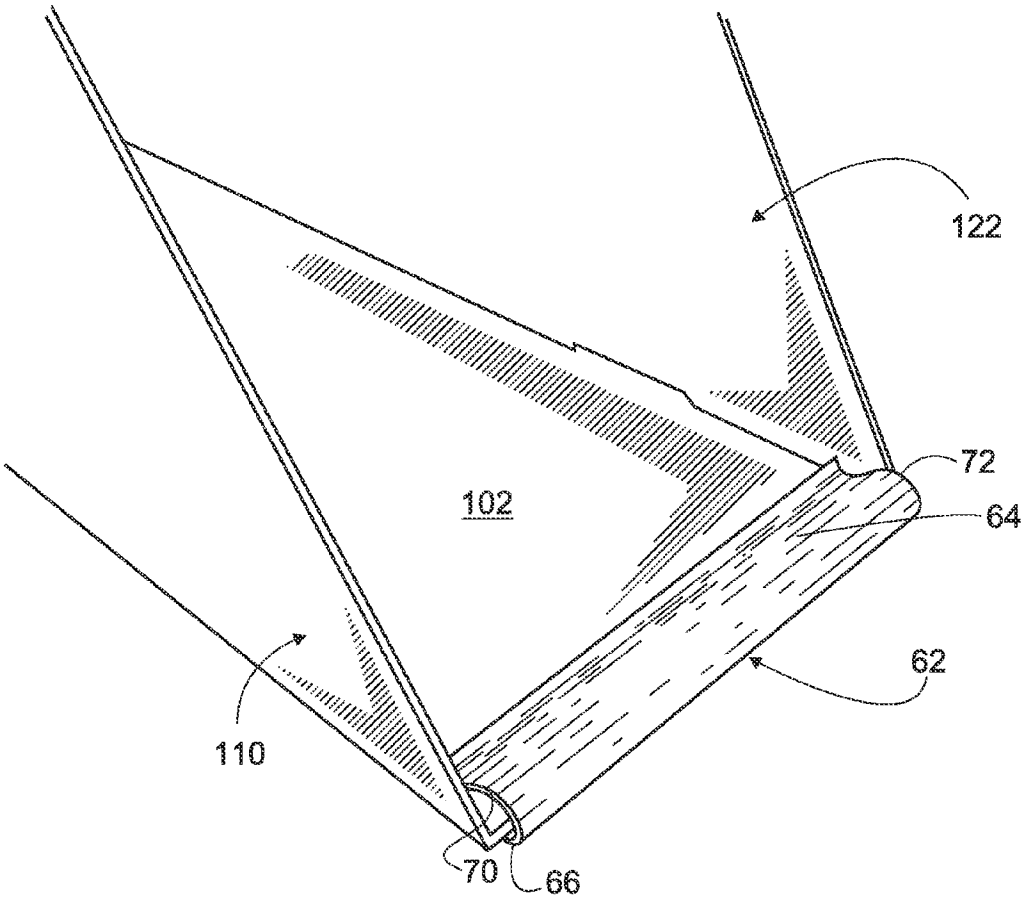
FIG. 4 is a perspective view of the device of the first embodiment showing a bumper engaged with a front edge of the bottom wall.
Figure 5:
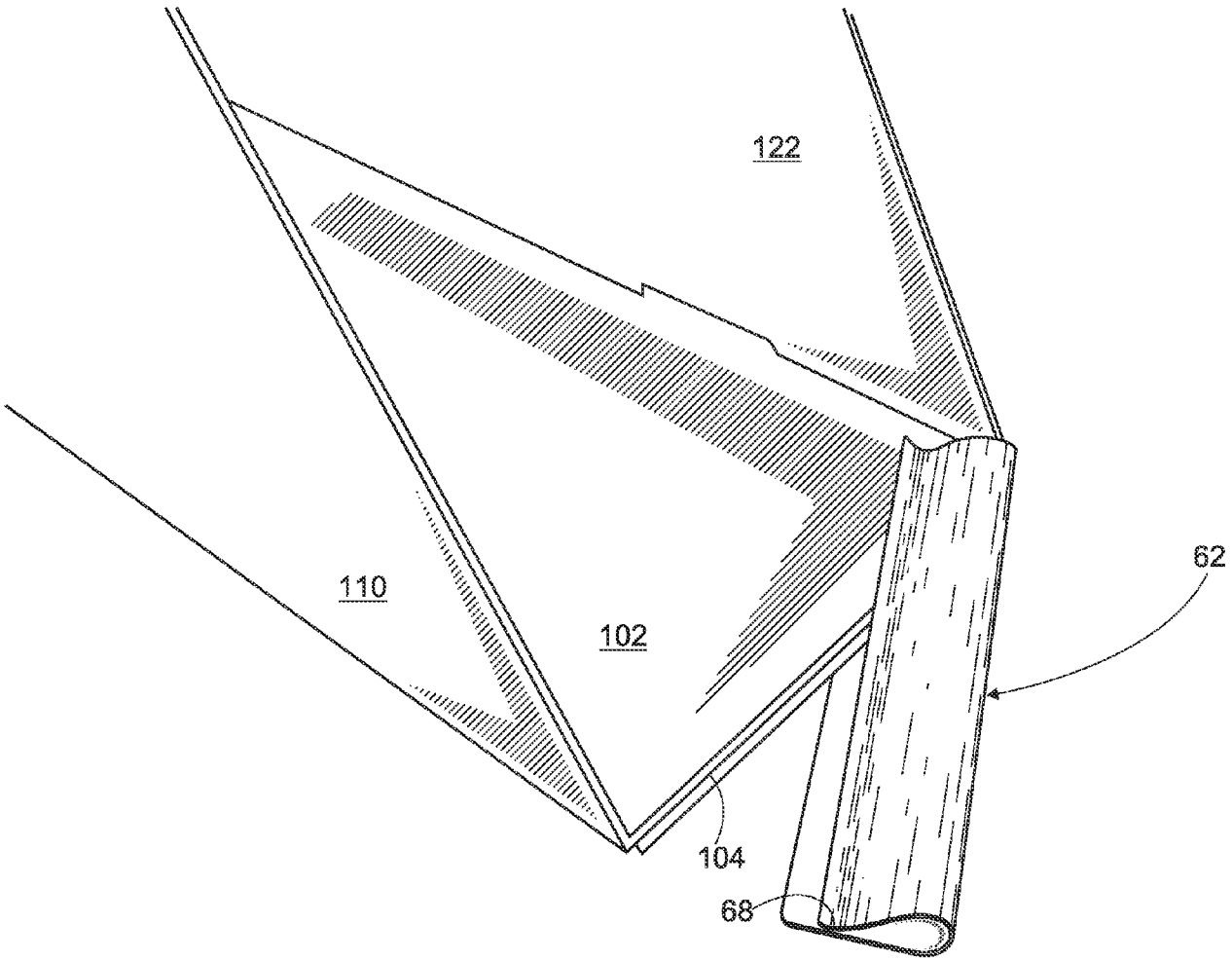
FIG. 5 is a perspective view of the device of the first embodiment showing the bumper partially removed from the front edge of the bottom wall.

Referring to FIGS. 4 and 5, device 100 further comprises a bumper 62 engaged with front edge 103 and front edge 105 of inner and outer bottom walls 102 and 104, respectively. Bumper 62 extends along upper front edge 103 and lower front edge 105 of inner bottom wall 102 and outer bottom wall 104 from first sidewall 110 to second sidewall 122. Bumper 62 is made from a flexible material such as, but not limited to, rubber or plastic or any combination thereof. Bumper 62 further comprises an upper wall 64, a lower wall 66, a channel 68 (FIG. 5), a first end 70, and a second end 72. As shown in FIG. 5, bumper 62 engages with or is mounted to front edge 103 of inner bottom wall 102 and front edge 105 of outer bottom wall 104 between upper and lower walls 64 and 66 of bumper 62. Bumper 62 provides frictional support to device 10 against the pulling force applied by a customer when dispensing flexible tubing 54 (FIG. 1). Bumper 62 also prevents a consumer from contacting front edge 103 of inner bottom wall 102 and front edge 105 of outer bottom wall 104. Bumper 62 also prevents damage to front edges 103 and 105 of inner and outer bottom walls 102 and 104. Bumper 62 may take different forms. By way of example only, bumper 62 may employ multiple pieces engaged with front edges 103 and 105 rather than one-piece.

Device 100 may employ products other than flexible tubing 54. By way of example only, device 100 may employ a rope, a chain, a wire or wall paper, or any other elongated flexible product suited for dispensing from a spool.

Figure 6:
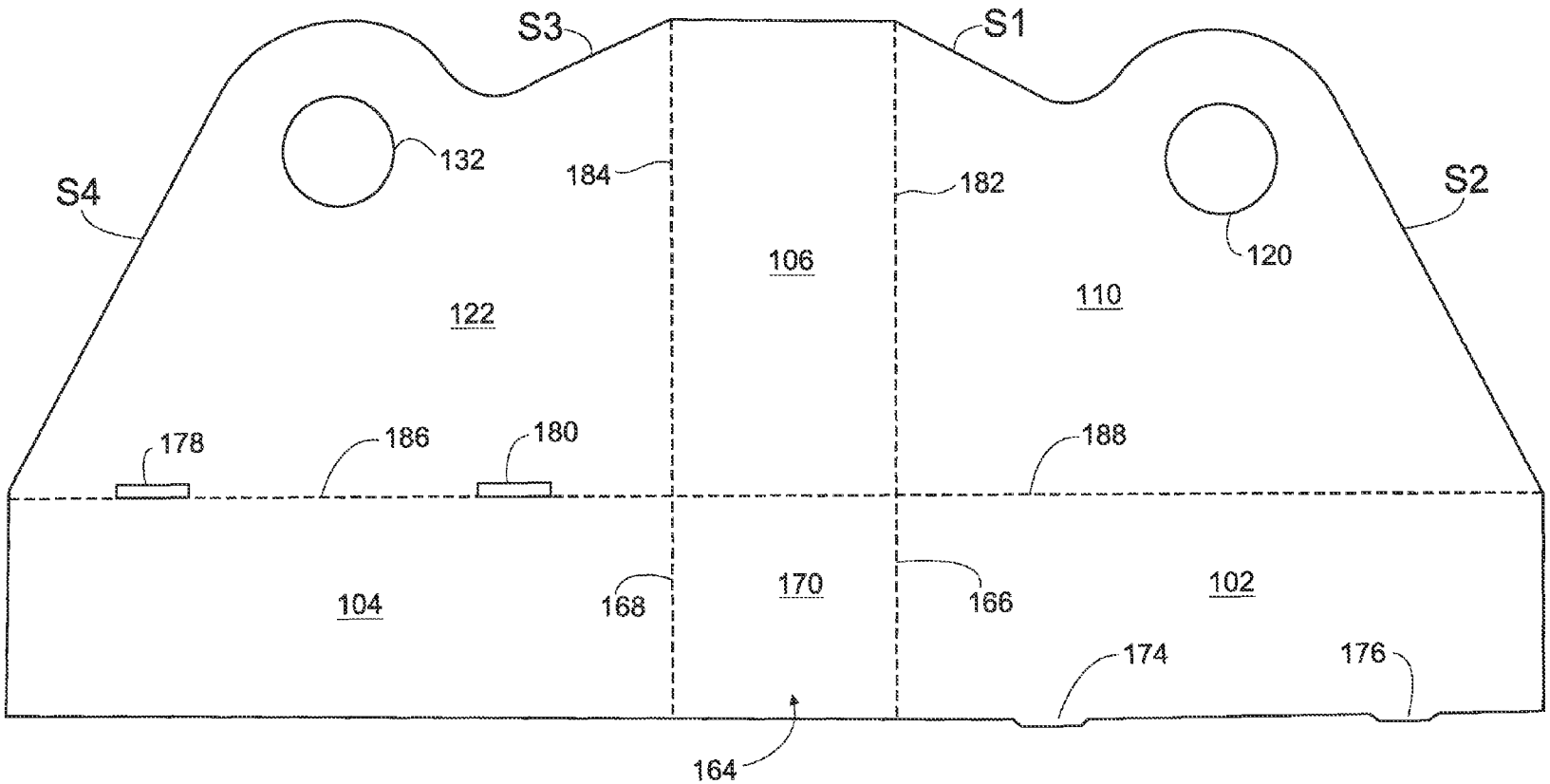
FIG. 6 is a top plan view of a cardboard sheet showing various cut and fold lines to form the one-piece housing of the first embodiment.

Referring to FIG. 6, one-piece housing 101 is fabricated from a single cardboard sheet 164 having various cut-lines and fold lines which allow sheet 164 to be folded to the desired shape. Sheet 164 comprises a cut line 166, a cut line 168, a rear wall flap 170, inner bottom wall 102, outer bottom wall 104, a first tab 174, and a second tab 176 extending outward from inner bottom wall 102. Sheet 164 further comprises a first slot 178 and a second slot 180 cut in second sidewall 122. Sheet 164 further comprises a first vertical fold line 182, a second vertical fold line 184, a first horizontal fold line 186 and a second horizontal fold line 188. One-piece housing 101 is formed by pre-folding cardboard sheet 164 along fold lines 182, 184, 186, and 188. After pre-folding, cuts are made along cut lines 166 and 168. After cutting, sheet 164 is folded along fold lines 182, 184, 186, and 188. Inner bottom wall 102 is then folded above outer bottom wall 104 and tabs 174 and 176 are inserted into slots 180 and 178, respectively. Leading straight edge 114 of first sidewall 110 has a slope S2 and trailing straight edge 116 of first sidewall 122 has a slope S1. Slope S2 is larger than slope S1. Leading straight edge 126 of second sidewall 122 has a slope S4. Trailing straight edge 128 of second sidewall 122 has a slope S3. Slope S4 is larger than slope S3. The sloped walls of device 100 reduce the consumption of material and overall cost. The sloped walls of device 100 further provide structural stability during dispensing. Sheet 164 further comprises openings 120 and 132 which as previously described are cut into sidewalls 110 and 122, respectively.

Figure 7:
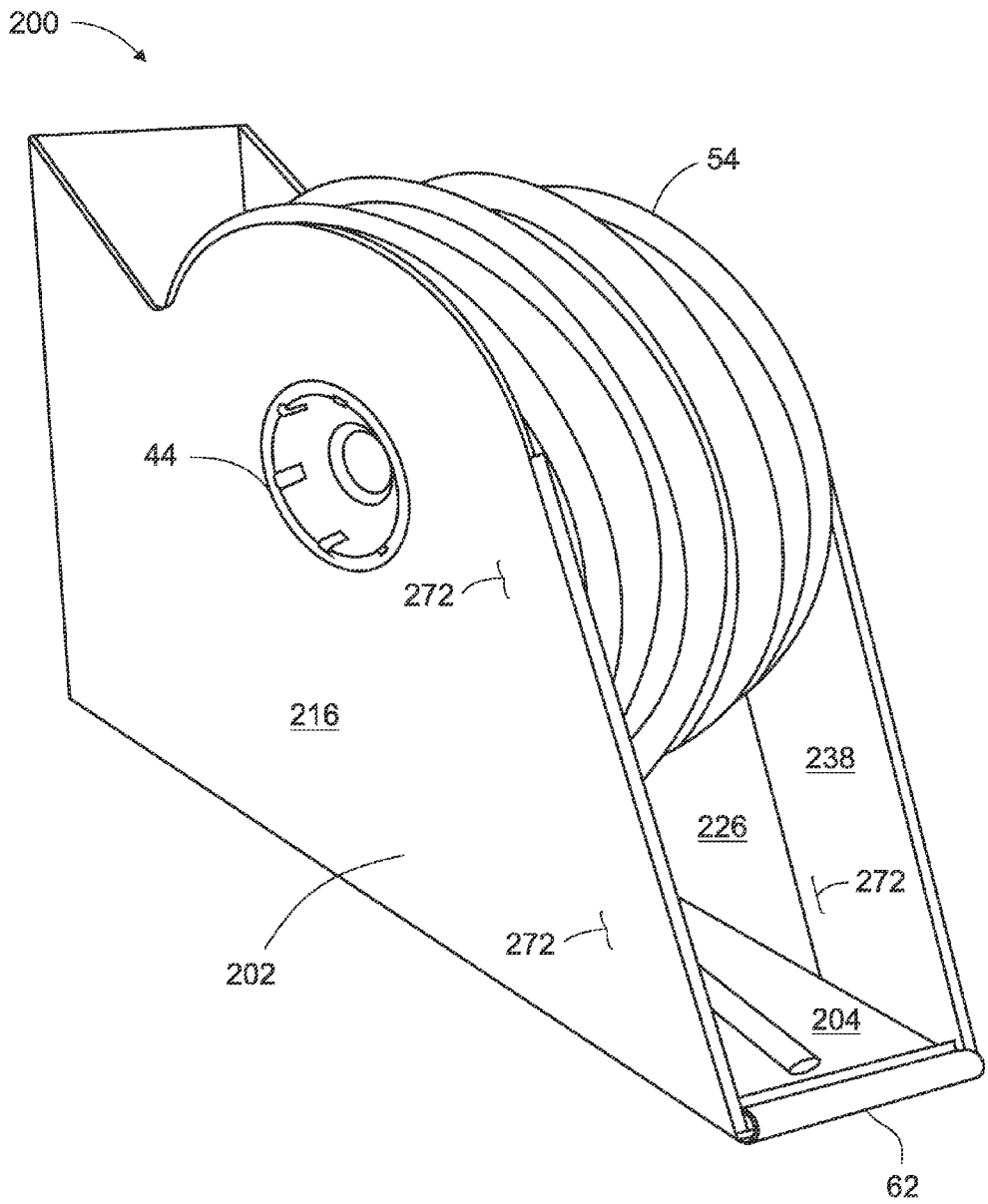
FIG. 7 is a perspective view of a device according to a second embodiment of the present invention showing left and front sidewalls having smooth leading walls.

Referring to FIG. 7, a device 200 according to a second embodiment of the present invention generally comprises a one-piece housing 202, a spool assembly 44, a flexible tubing 54 wound upon a spool assembly 44, and a bumper 62. Spool assembly 44, flexible tubing 54, and bumper 62 have been described in connection with device 100 (FIGS. 1-3).

Figure 8:
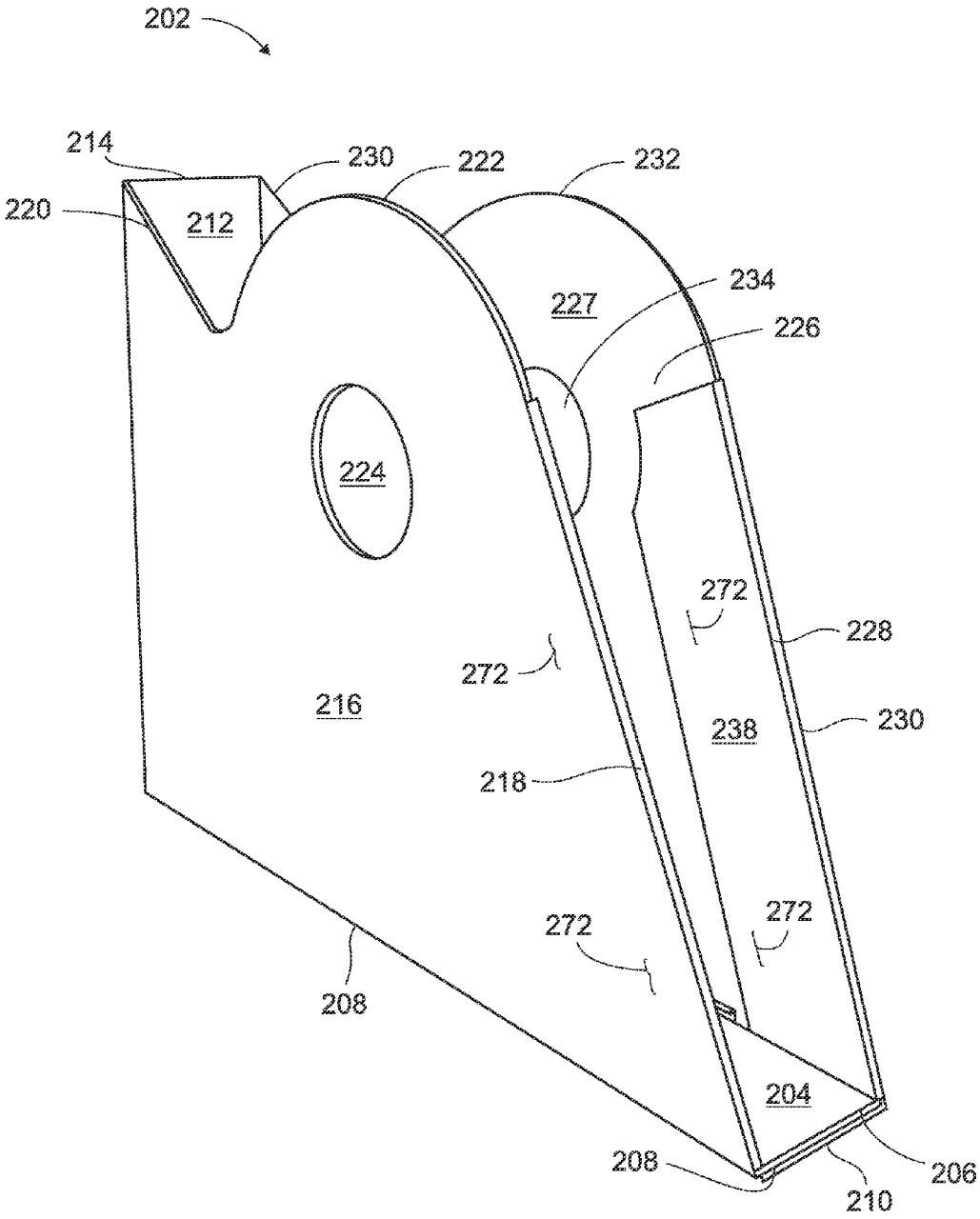
FIG. 8 is a perspective view of an assembled one-piece housing of the device according to the second embodiment.
Figure 9:
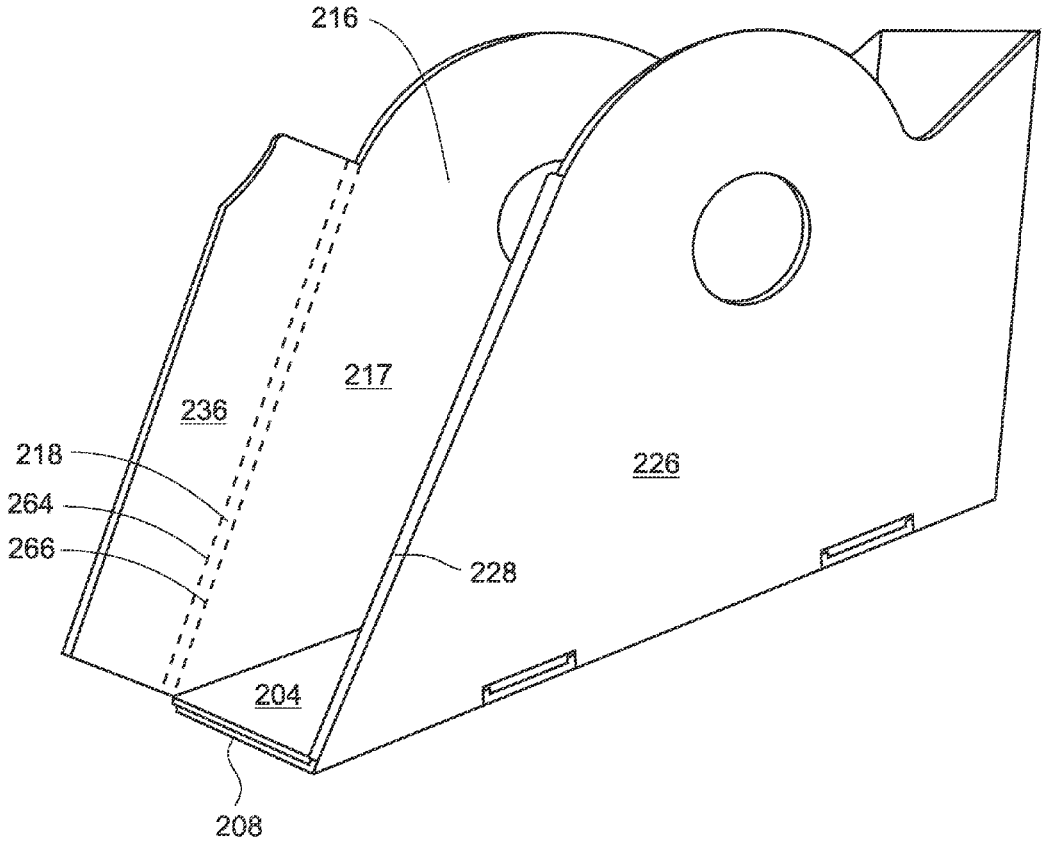
FIG. 9 is a perspective view of the one-piece housing according to the second embodiment showing a left or first flap in an open position extending from a front portion of the first sidewall of the one-piece housing.
Figure 10:
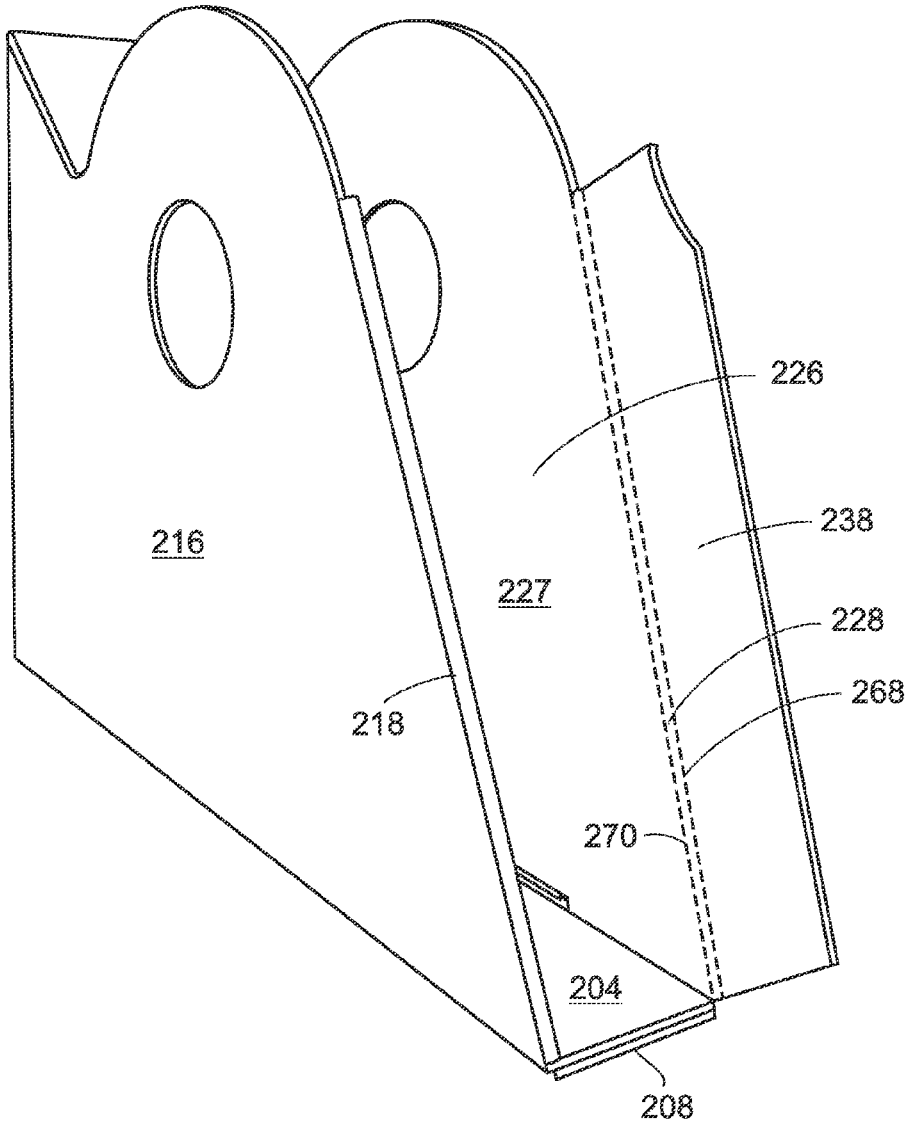
FIG. 10 is a perspective view of the one-piece housing according to the second embodiment showing a right or second flap in an open position extending from a front portion of the second sidewall of the one-piece housing.

Referring to FIGS. 8-10, one-piece housing 202 generally comprises an inner bottom wall 204, an outer bottom wall 208, a rear wall 212, a first sidewall 216, and a second sidewall 226. Inner and outer bottom walls 204 and 208 comprise a front edge 206 and a front edge 210, respectively. Rear wall 212 comprises an outside edge 214. First and second sidewalls 216 and 226 extend upward from bottom walls 204 and 208 and are substantially perpendicular to rear wall 212. First sidewall 216 comprises a smooth leading wall 218, a trailing straight edge 220, and a curved edge 222. Curved edge 222 is disposed between smooth leading wall 218 and trailing straight edge 220. Second sidewall 226 comprises a smooth leading wall 228, a trailing straight edge 230 and a curved edge 232. Curved edge 232 is disposed between smooth leading wall 228 and trailing straight edge 230. Smooth leading walls 218 and 228 substantially reduce the likelihood of a customer obtaining a paper-cut while dispensing flexible tubing 54. Smooth leading wall 218 is formed by a flap 236 that is folded upon inside surface 217 of first sidewall 216 (FIG. 9). Smooth leading wall 220 is formed by a flap 238 that is folded upon inside surface 227 of second sidewall 226 (FIG. 10). Flaps 236 and 238 are securely attached to first and second sidewalls 216 and 226 by conventional means such as staples 272.

Figure 11:
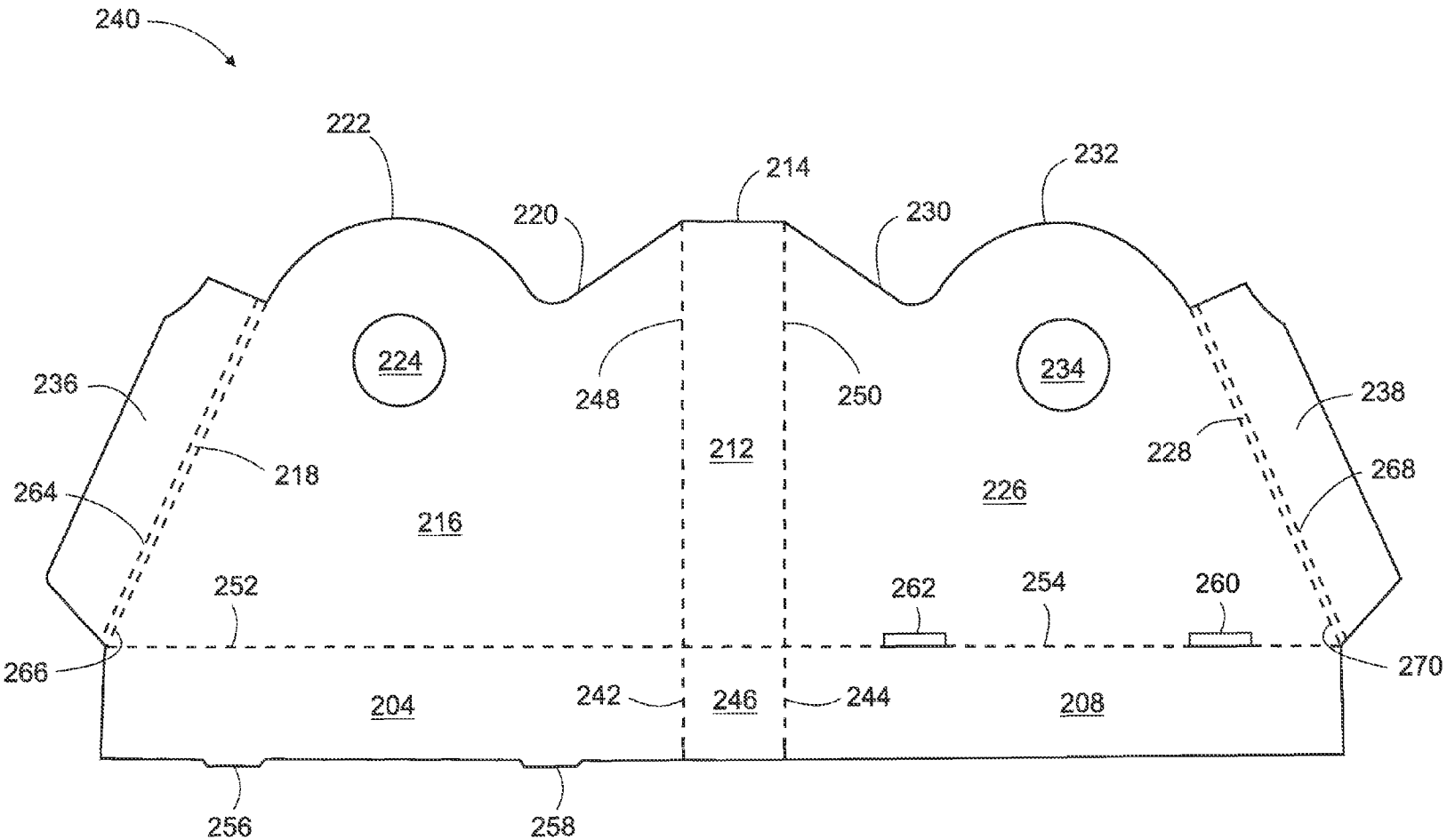
FIG. 11 is a top plan view of a cardboard sheet showing various cut and fold lines to form the one-piece housing of the second embodiment.

Referring to FIG. 11, one-piece housing 202 is fabricated from a sheet 240 of cardboard by cutting, folding, and stapling operations. Sheet 240 comprises inner and outer bottom walls 204 and 208, rear wall 212, and first and second sidewalls 216 and 226. Sheet 240 further comprises cut-lines 242 and 244 that form a rear wall flap 246. Sheet 240 further comprises horizontal fold lines 252 and 254 that allow inner and outer bottom walls 204 and 208 to be folded. Sheet 240 further comprises vertical fold lines 248 and 250 that allow first and second sidewalls 216 and 226 to be folded. Sheet 240 further comprises tabs 256 and 258 extending outward from inner bottom wall 204. Sheet 240 further comprises slots 260 and 262 cut in second sidewall 226 adjacent horizontal fold line 254. When folded, tabs 256 and 258 of inner bottom wall 204 are inserted into slots 260 and 262 of second sidewall 226. For added stability, inner bottom wall 204 may be stapled to outer bottom wall 208 by staples 272. Sheet 240 further comprises openings 224 and 234 cut into first and second sidewalls 216 and 226 to receive spool assembly 44 as described in connection with device 100 (FIGS. 1-3). Sheet

240 further comprises flaps 236 and 238 extending outward from first and second sidewalls 216 and 226, respectively, below curved edges 222 and 232. Sheet 240 further comprises folds lines 264 and 266 so flap 236 may be folded upon inside surface 217 of first sidewall 216 to form smooth leading wall 218. Sheet 240 further comprises folds lines 268 and 270 so flap 238 may be folded upon inside surface 227 of second sidewall 226 to form smooth leading wall 228.

In another embodiment, smooth leading walls 218 and 228 of first and second sidewalls could be formed by replacing flaps 236 and 238 with plastic strips attached to leading straight edges 114 and 126 of first and second sidewalls 110 and 122 (FIG. 2) by conventional means such as adhesive or they may be self attaching or clip-on type plastic strips.

While particular embodiments of the invention have been shown and described, it will be obvious to those skilled in the art that changes and modifications may be made without departing from the scope of the claimed invention.

What is claimed is:

1. A device for dispensing flexible tubing upon a shelf comprising:

(a) a one-piece housing comprising an inner bottom wall comprising a front edge; an outer bottom wall comprising a front edge; a rear wall extending upward from said outer bottom wall; a first sidewall extending upward from said inner bottom wall; said first sidewall is substantially perpendicular to said rear wall; said first sidewall comprises a smooth leading wall, a trailing straight edge, and a curved edge disposed between said smooth leading wall and said trailing straight edge; and a second sidewall extending upward from said outer bottom wall; said second sidewall is substantially perpendicular to said rear wall and parallel to said first sidewall; said second sidewall comprises a smooth leading wall, a trailing straight edge, and a curved edge disposed between said smooth leading wall and said trailing straight edge; said smooth leading wall of said first sidewall is a first flap folded upon said first sidewall;

(b) a spool assembly engaged with said first and second sidewalls; and (c) flexible tubing wrapped about said spool member.

2. The device of claim 1, wherein said smooth leading wall of said second sidewall is a second flap folded upon said second sidewall.

3. The device of claim 2, wherein said first and second flaps are secured to said first and second sidewalls, respectively, by staples.

4. The device of claim 3, wherein said first and second flaps are integrally formed with said first and second sidewalls, respectively.

5. The device of claim 4, further comprising a bumper engaged with said front edge of said inner and outer bottom walls; said bumper extending substantially from said first sidewall to said second sidewall.

6. The device of claim 5, wherein said one piece housing is made from card board.

* * * * *